United States Patent [19]

Seshadri et al.

[11] Patent Number: 4,537,047

[45] Date of Patent: Aug. 27, 1985

[54] TRUCK TRANSPORT REFRIGERATION UNIT

[75] Inventors: Jayaram Seshadri; Daniel T. Neimy, both of Minneapolis, Minn.

[73] Assignee: Thermo King Corporation, Minneapolis, Minn.

[21] Appl. No.: 585,683

[22] Filed: Mar. 2, 1984

[51] Int. Cl.[3] ..... F25B 1/10

[52] U.S. Cl. ..... 62/510; 417/8

[58] Field of Search ..... 62/510, 175; 236/1 EA; 417/5, 7, 8

[56] References Cited

U.S. PATENT DOCUMENTS

| | | | |
|---|---|---|---|
| 2,221,688 | 11/1940 | Gibson | 62/175 |
| 2,294,552 | 9/1942 | Gycax | 62/510 X |
| 2,319,502 | 5/1943 | Gould | 62/175 X |
| 3,122,003 | 2/1964 | Sullivan | 62/175 X |
| 3,386,262 | 6/1968 | Hackbart et al. | 62/510 X |
| 3,785,169 | 1/1974 | Gylland, Jr. | 417/7 X |
| 3,970,413 | 7/1976 | Duveau | 417/7 |
| 3,984,224 | 10/1976 | Dawkins | 62/510 X |
| 4,418,548 | 12/1983 | Sawyer | 62/175 |

*Primary Examiner*—William E. Tapolcai
*Attorney, Agent, or Firm*—E. C. Arenz

[57] ABSTRACT

A transport refrigeration unit of the type which has a single or common refrigerant circuit, and a truck engine driven compressor 22 and a mutually, exclusively operable standby compressor 34 is provided with an arrangement of suction line fitting 46 with a pair of check valves 64 and 66 located physically above the fitting which receives the suction side refrigerant through line 48 from below the fitting and is provided with an inversely related pressure side fitting 54 with associated check valves 68 and 70 and the compressors are of substantially identical pumping capacity and oil capacity, all to the end of preventing an interchange of oil between the compressors during operation, and to migration of refrigerant and oil during periods of inoperation.

4 Claims, 2 Drawing Figures

10
12
14
16
18
20
22
24
26
28
30
32
34
36
38
40
42
44
46
48
50
52
54
56
58
60
62
64
66
68
70
72
74
76
78
S
D

TRUCK TRANSPORT REFRIGERATION UNIT

BACKGROUND OF THE INVENTION

This invention pertains to that type of truck transport refrigeration unit typically used on medium-sized straight trucks for delivery of refrigerated loads to limited distances and for limited periods of time. The particular type of refrigerant unit with which this invention is concerned has a single refrigerant system circuit, but is provided with one refrigerant compressor driven by the truck engine, and a separate refrigerant compressor, usually called a standby compressor, located in the refrigerant unit itself as distinct from the truck engine compressor located in the truck engine compartment. The truck engine compressor is used when the truck is on the road makings its deliveries. The standby compressor, which is electrically driven from a source of electricity at the truck terminal, is used when the truck is at the terminal and is to have its load space refrigerated.

This general type of transport unit, that is one which uses two separate compressors, with a single circuit refrigeration system, is well known in the art. One problem that can be experienced with arrangements of this general type relates to one or the other compressors having an inadequate oil supply due to the oil being accumulated in the other compressor. Thus, if the compressor which has an inadequate oil supply is the particular compressor to be used, damage and/or destruction of that compressor with inadequate oil can result.

It is well understood in the refrigerant art that refrigerant oil is miscible with the refrigerant which, of course, is being pumped through the refrigerant system by the compressor. It is also understood refrigerant migration, carrying the oil with the refrigerant, occurs both due to gravity, and due to different temperatures prevailing in the system. Refrigerant will migrate from a higher temperature location to a lower temperature location. In a transport refrigeration system of the type with which this invention is concerned, different temperatures at different locations in the overall system naturally occur since the evaporator coil and associated elements are located in the load space of the truck, the condenser section including the condenser coil, the electrically driven standby compressor, and other associated elements is located exteriorly of the load space and typically on the front wall of the truck body, and the truck engine compressor is located in the truck engine compartment. Thus, it will be readily apparent that different temperatures can be experienced at these three different locations in accordance with various operational and temperature conditions.

In the prior art commercial arrangements of which we are aware, the two compressors used in the arrangements have had significantly different pumping capacities, as well as different oil capacities in the compressors. In one particular arrangement of which we are aware, the truck engine compressor has six times the pumping capacity of the electric standby compressor, even though the oil capacity of the truck engine compressor is less than the oil capacity of the electric standby compressor. The prior art arrangements have either used solenoid value to control the circuiting of the refrigerant flow in accordance with which compressor is operating, or have used check valves. It is our view that the use of check valves is superior to solenoid value since the rate of leakage through a solenoid value as compared with a check valve is in the order to 6 to 8 to 1. The prior art arrangement using check valves is considered inferior to our arrangement in that the force of gravity is in a direction aiding migration rather than opposing migration.

Thus, it is the aim of this invention to provide an overall refrigerant system arrangement of the two compressor type for a straight truck in which imbalances in oil for the two compressors due both to compressor operation and to oil migration is substantially prevented.

SUMMARY OF THE INVENTION

In accordance with the invention, a transport refrigeration unit of the type generally described and having two separate, mutually exclusively operable refrigerant compressors connected to a common refrigerant circuit is provided with an arrangement for preventing undue oil and refrigerant migration from one compressor to another is provided including both of the compressors being substantially identical with respect to pumping and oil capacity, and with each compressor suction line being connected through a separate check valve to a first fitting connected to the refrigerant system suction line, and with each compressor discharge line being connected through a separate check valve to a second fitting connected to the refrigerant system pressure line, and with the refrigerant system suction line being connected to the physical bottom side of the first fitting and with the suction side check valves being located physically above the first fitting.

DESCRIPTION OF THE PREFERRED EMBODIMENTS

Figures 1, 2:
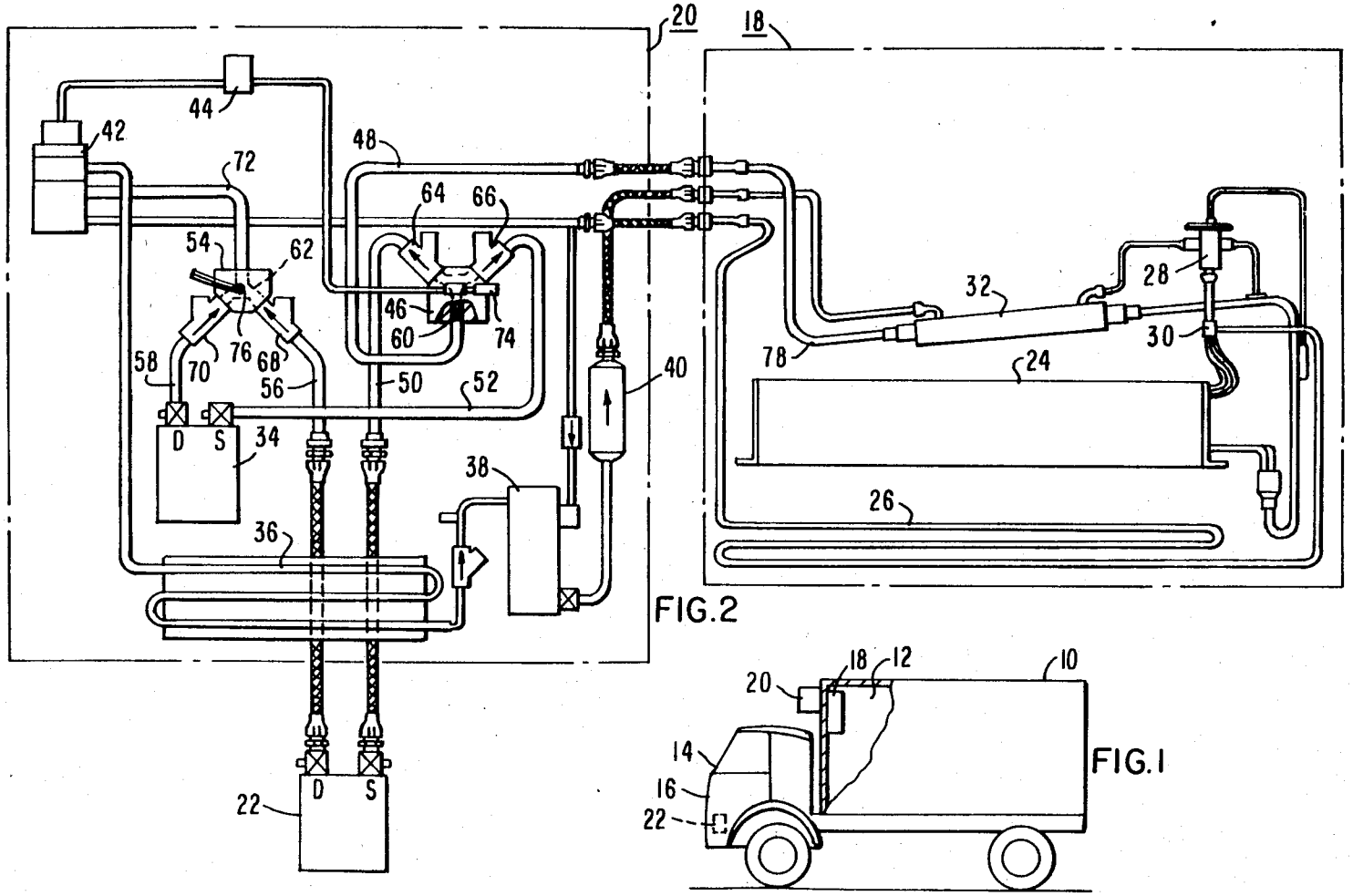
FIG. 1 is a side elevational view, basically in outline form, of a straight truck provided with a transport refrigeration unit of the type with which the invention is concerned.
FIG. 2 is a diagrammatic view of the refrigeration system according to the invention.

Referring to FIG. 1, the typical straight truck includes the body 10 containing the load or cargo space 12 and a cab 14 which includes an engine compartment 16.

The refrigeration unit includes three physically separated parts comprising an evaporator section 18 located in the cargo space 12, a condenser section 20 mounted on the front wall of the body 10, and an engine-driven compressor 22 located in the engine compartment 16. The basic arrangement thus far described is conventional in this art.

Referring to FIG. 2, the parts of the refrigeration system physically located in the evaporator section 18 are found within the rectangle also identified by the numeral 18. These parts include the evaporator coil 24, a defrost tube 26, expansion valve 28, distributor 30 and heat exchanger 32.

Continuing with FIG. 2, the parts physically located inside the condenser section 20 are illustrated within the rectangle also identified by the numeral 20. They include the electric standby compressor 34, condenser coil 36, refrigerant receiver 38, refrigerant dryer 40, three-way valve 42 which functions to shift from cooling to defrost, or from cooling to heating if the system is so arranged, under the control of the pilot solenoid 44, a first, suction side fitting 46 which serves as a junction between the suction return line 48 from the evaporator section and the suction lines 50 and 52 to the two compressors 22 and 34, respectively, and a second, pressure side fitting 54 which serves as a junction to receive high pressure refrigerant through the discharge lines 56 and 58 connected to the discharge of the two compressors 22 and 34, respectively.

Each of the first and second fittings 46 and 54 are in the form of a block provided with internal Y-shaped passages 60 and 62, respectively. The stem of the Y-shaped passage 60 is the inlet to the block and is connected to the suction line 48 connected to the outlet of the heat exchanger 32. The arms of the Y-shaped passage 60 are connected to the inlets of check valves 64 and 66 which are physically located, as is shown in FIG. 2, above the outlets of the first fitting. It is also to be noted that the suction line 48 feeds to the fitting 46 from below and into the physical bottom side of the fitting.

The pressure side fitting 54 also has two check valves 68 and 70 connected to the fitting and arranged to permit high-pressure refrigerant from either of the operating compressors to enter the arms of the Y-shaped passage 62, the stem of the passage being connected to the pressure side line 72 leading to the three-way valve 42. Thus, it will be seen that the pressure side fitting is basically inverted with respect to the suction side fitting, and with the check valves 68 and 70 being reversely oriented with respect to the suction fitting check valves, in the sense that the pressure check valves are physically below the fitting.

As is conventional in the art, the suction fitting 46 is provided with a low pressure cut-out 74 while the pressure fitting 54 is provided with a high pressure cut-out 76.

An important aspect of the invention is that the two compressors 22 and 34 have substantially the same pumping and oil capacities. Thus, to the extent that any oil does shift from one compressor to the other under migrating conditions, the effect of any imbalance will not be as severe as in the prior art arrangement in which the truck engine compressor had a pumping rate in the order of six times that of the standby compressor, but had an oil capacity of only slightly more than half of that of the standby compressor.

Another important aspect of the invention to prevent migration when the system is not operating is the inlet to the suction fitting 46 from the suction line 48 at the bottom of the fitting, and the physically elevated positions of the two check valves 64 and 66, which require refrigerant and oil trying to migrate to work against the force of gravity.

Also in accordance with the invention and as is shown in FIG. 2, the heat exchanger 32 is tilted at approximately a 15° angle with the horizontal so that the section 78 of the suction line 48, which is a smaller cross-sectional area than the passage of the same suction gas through the heat exchanger 32, will serve to accumulate oil in the lower portion of the section 78 where the gas velocity will be higher than in the heat exchanger 32, because of the lesser diameter of that section 78.

As an example of the operation of the truck and the refrigeration system, when the truck is at the terminal and the cargo space of any cargo is to be cooled, the standby compressor 34 is operated by being electrically connected to a stationary source of power at the terminal. Then, when the load is to be delivered, the standby compressor 34 is disconnected, and the truck engine compressor 22 is operated by the engine in accordance with thermostatic demands. When the standby compressor 34 operates, the discharge is through the line 58 and check valve 70 with the pressure in the passage 62 and the force of the spring of check valve 68 front seating the check valve 68 to prevent flow through line 56 to the truck engine compressor 22.

On the suction side, the return suction gas through line 48 flows through check valve 66 and line 52 back to the suction side of the standby compressor 34, while the check valve 64 front seats due to the spring pressure and the suction pressure, so as to prevent flow through line 50 to the other compressor. When the truck engine compressor 22 is operated and the standby compressor 34 is inactive, the reverse flow situation with reverse positioning of the check valves associated with the two fittings occurs.

After the truck has returned to the terminal after a run, and is to be idle for a period, the temperature situation of the components at the various locations may differ significantly, and in accordance with the ambient temperature conditions. For example, in cold weather conditions, the truck engine compressor 22 which has been operating on the trip may be relatively warm compared to the standby compressor 34 which is exposed to ambient and the evaporator section parts may be colder than the standby compressor. It is in this idled condition that the migration of refrigerant and oil can cause an imbalance in the oil available to compressors, and it is in part to prevent this situation with which the invention is concerned.

We claim:

1. For a transport refrigeration unit of the type adapted for temperature conditioning a load in a truck having an engine compartment, and having two separate, mutually exclusively operable refrigerant compressors connected to a common refrigerant system circuit, one of said compressors being located in said engine compartment and driven by the truck engine and the other compressor being electrically driven and located away from said engine compartment, an arrangement for preventing undue oil and refrigerant exchange between one compressor and the other, wherein:

both said compressors are substantially identical with respect to pumping and oil capacity;

each compressor suction line is connected to a separate check valve to a first fitting connected to the refrigerant system suction line;

each compressor discharge line is connected to a separate check valve to a second fitting connected to the refrigerant system pressure line; and said refrigerant system suction line is connected to the physical bottom side of said first fitting and said check valves are physically located above said first fitting.

2. An arrangement according to claim 1 wherein:

said first fitting is in the form of a block providing a Y-shaped passage from said suction line connection to the inlets of said check valves.

3. An arrangement according to claim 2 wherein:

said second fitting and its respective check valves are in inverted relation relative to said first fitting and its respective check valves.

4. An arrangement according to claim 1 wherein:

said refrigerant system includes heat exchanger means, and said suction line connected to said first fitting at one end and to said heat exchanger at the other end includes a downwardly inclined length thereof to facilitate the pickup of liquid from said inclined portion.

* * * * *